US005359847A

United States Patent [19]

Pillsbury et al.

[11] Patent Number: 5,359,847

[45] Date of Patent: Nov. 1, 1994

[54] DUAL FUEL ULTRA-LOW NOX COMBUSTOR

[75] Inventors: Paul W. Pillsbury, Winter Springs; David T. Foss, Winter Park, both of Fla.

[73] Assignee: Westinghouse Electric Corporation, Pittsburgh, Pa.

[21] Appl. No.: 69,496

[22] Filed: Jun. 1, 1993

[51] Int. Cl.[5] ..... F02C 7/26

[52] U.S. Cl. ..... 60/39.06; 60/39.463; 60/737; 60/742; 60/748

[58] Field of Search ..... 60/39.06, 39.463, , 60/737, 739, 740, 742, 748, 39.37; 239/416.1, 416.4, 404, 405, 406

[56] References Cited

U.S. PATENT DOCUMENTS

| | | | |
|---|---|---|---|
| 3,691,765 | 9/1972 | Carlisle | 60/742 |
| 3,788,067 | 1/1974 | Carlisle et al. | 60/748 |
| 3,937,011 | 2/1976 | Caruel et al. | 60/742 |
| 4,216,517 | 4/1981 | Hopkins et al. | 239/406 |
| 4,447,010 | 5/1984 | Maeda et al. | 239/416.1 |
| 5,044,559 | 9/1991 | Russell et al. | 239/406 |
| 5,069,029 | 12/1991 | Kuroda et al. | 60/737 |
| 5,121,597 | 6/1992 | Urushidani et al. | 60/747 |
| 5,218,824 | 6/1993 | Cederwall et al. | 60/742 |
| 5,235,814 | 8/1993 | Leonard | 60/738 |
| 5,237,812 | 8/1993 | Mumford | 60/39.463 |

FOREIGN PATENT DOCUMENTS

| | | | |
|---|---|---|---|
| 00119423 | 9/1981 | Japan | 60/39.37 |
| 0063721 | 3/1989 | Japan | 60/737 |
| 0093210 | 4/1990 | Japan | 60/737 |
| 0183720 | 7/1990 | Japan | 60/737 |

OTHER PUBLICATIONS

D. Owen et al., "Low Emissions Combustor Design Options for an Aero Derived Industrial Gas Turbine", Canadian Gas Assoc. Symposium, Banff, Alberta (Oct. 16–18, 1991).

*Primary Examiner*—Richard A. Bertsch
*Assistant Examiner*—Timothy S. Thorpe

[57] ABSTRACT

An ultra-low NOx gas turbine combustor having a dual fuel capability. The combustor has a pre-mixing zone and a downstream combustion zone. The pre-mixing zone has three concentric annular passages that surround a central diffusion-type dual fuel nozzle. A gas fuel manifold distributes gas fuel around the inner and outer passages. A plurality of dual fuel nozzles are disposed in the middle passage to distribute either gas or oil fuel around the middle passage. The distribution of fuel around the passages allows the formation of lean fuel/air ratios, thereby lowering NOx formation. In addition, swirl vanes are arrayed around the inner and outer passages and around each of the fuel nozzles. A step increase in the flow area in going from the pre-mixing zone to the combustion zone creates vortices that tend to anchor the flame.

20 Claims, 5 Drawing Sheets

DUAL FUEL ULTRA-LOW NOX COMBUSTOR

BACKGROUND OF THE INVENTION

The present invention relates to a combustor capable of burning two fuels in compressed air. More specifically, the present invention relates to a combustor for a gas turbine capable of operating on either a gaseous or liquid fuel that significantly reduces the amount of NOx produced by combustion.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Additional air was introduced into the combustor downstream of the primary combustion zone. Although the overall fuel/air ratio was considerably less than stoichiometric, the fuel/air mixture was readily ignited at start-up and good flame stability was achieved over a wide range in firing temperatures due to the locally richer nature of the fuel/air mixture in the primary combustion zone.

Unfortunately, use of such approximately stoichiometric fuel/air mixtures resulted in very high temperatures in the primary combustion zone. Such high temperatures promoted the formation of oxides of nitrogen ("NOx"), considered an atmospheric pollutant. It is known that combustion at lean fuel/air ratios reduces NOx formation. Such lean burning, however, requires that the fuel be well distributed throughout the combustion air without creating any locally rich zones. Unfortunately, the geometry associated with such fuel distribution creates a complex structure that makes the incorporation of a dual fuel capability into the combustor extremely difficult.

It is therefore desirable to provide a combustor that is capable of stable combustion with very lean mixtures of fuel and air, so a to reduce the formation of NOx, and that is capable of operation on liquid as well as gaseous fuel.

SUMMARY OF THE INVENTION

Accordingly, it is the general object of the current invention to provide a combustor that is capable of stable combustion with very lean mixtures of fuel and air, so as to reduce the formation of NOx, and that is capable of operation on liquid as well as gaseous fuel.

Briefly, this object, as well as other objects of the current invention, is accomplished in a gas turbine, comprising (i) a compressor for compressing air, (ii) a combustor for producing a hot gas by burning a fuel in the compressed air, and (iii) a turbine for expanding the hot gas produced by the combustor. According to one embodiment of the invention, the combustor has (i) a combustion zone, (ii) a centrally disposed first fuel nozzle in flow communication with the combustion zone and having a first discharge port for discharging a liquid fuel and a second discharge port for discharging a gaseous fuel, (iii) first and second concentrically arranged annular passages surrounding the first fuel nozzle and in flow communication with the combustion zone, (iv) means for introducing a liquid fuel into the first passage so as to circumferentially distribute the liquid fuel around the first passage, (v) means for introducing a gaseous fuel into the second passage so as to circumferentially distribute the gaseous fuel around the second passage. In one embodiment of the invention, the combustor has means for introducing a gaseous fuel into the first passage so as to circumferentially distribute the gaseous fuel around the first passage.

In another embodiment, the combustor comprises (i) a shell forming a combustion zone in which a fuel is burned in compressed air, (ii) a fuel/air pre-mixing zone enclosed by a first liner, (iii) means for introducing a fuel into each of the passages, and (iv) means, disposed within the passages, for mixing the fuel introduced into each of the annular passages with the compressed air flowing through the passages. In this embodiment, the first liner encloses second and third liners so as to form a first annular passage between the first and second liners and a second annular passage between the second and third liners, each of the annular passages having an inlet in flow communication with the compressor and an outlet in flow communication with the shell, whereby a portion of the compressed air from the compressor flows through each of the annular passages. The pre-mixing zone has a flow area defined by an inner diameter of the first liner at the first passage outlet and the shell has a flow area adjacent the passage outlets defined by an inner diameter of the shell. The shell inner diameter is at least about 40% greater that the first liner inner diameter, whereby the compressed air flowing through the passages undergoes an expansion upon exiting the passages.

DESCRIPTION OF THE PREFERRED EMBODIMENT

Figure 1:
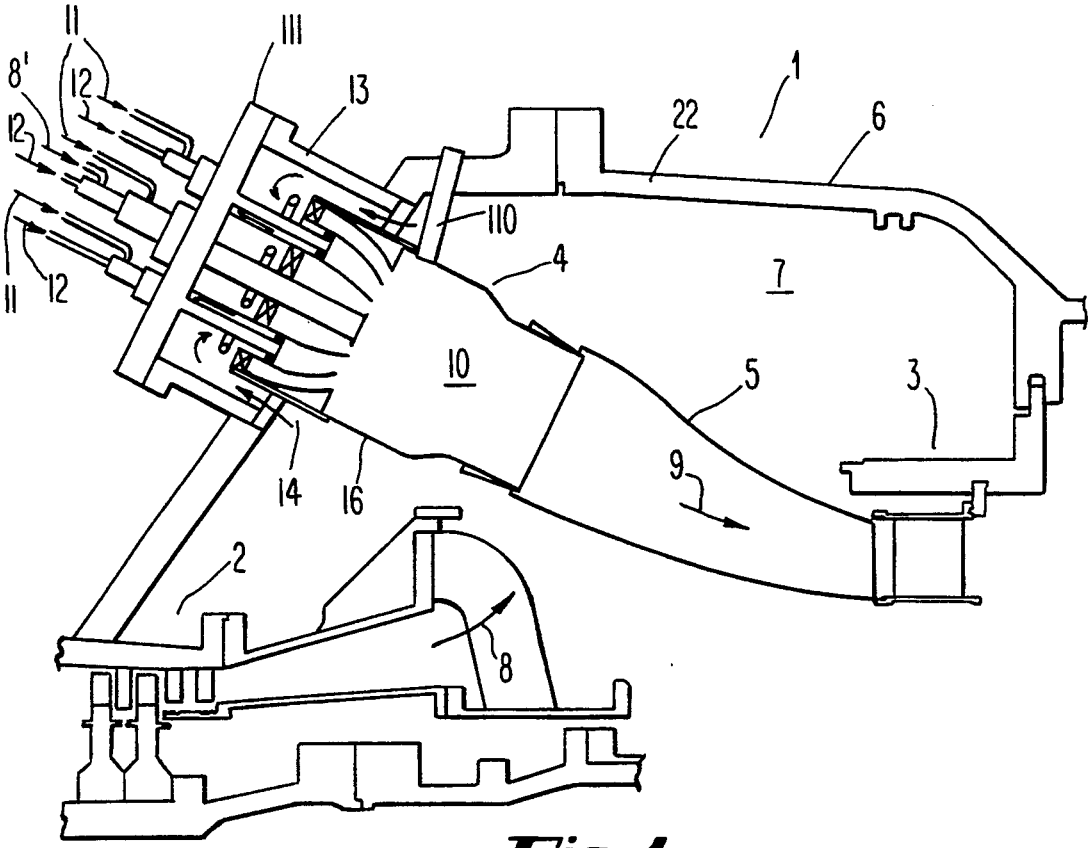
FIG. 1 is a longitudinal cross-section through a portion of a gas turbine in the vicinity of the combustion section.

Referring to the drawings, there is shown in FIG. 1 a portion of a gas turbine 1 in the vicinity of the combustion section 6. In addition to the combustion section 6, the gas turbine comprises a compressor section 2 and a turbine section 3. The current invention concerns a combustor 4 for the gas turbine 1—specifically, a combustor designed to generate very low levels of NOx (e.g., less than approximately 9 ppmv when the gas turbine is operating at its base load firing temperature on gas fuel and without the use of water or steam injection).

The combustion section 6 comprises a chamber 7 formed by an outer casing 22 of the gas turbine and in which a plurality of combustors 4 are circumferentially arrayed. Each combustor comprises a pre-mixing zone 14 and a combustion zone 10 downstream of the pre-mixing zone. Fuel 11,12 and compressed air 8 from the compressor 2 are mixed in the pre-mixing zone 14 and burned in the combustion zone 10. A casing 13 extends outward from the front face of the casing 22 and encloses a portion of the pre-mixing zone 14, as well as the combustor fuel supply piping. A duct 5 is connected to a vessel 16 that encloses the combustion zone 10 and directs the hot gas 9 produced by the combustor 4 to the turbine 3 for expansion.

Figure 2:
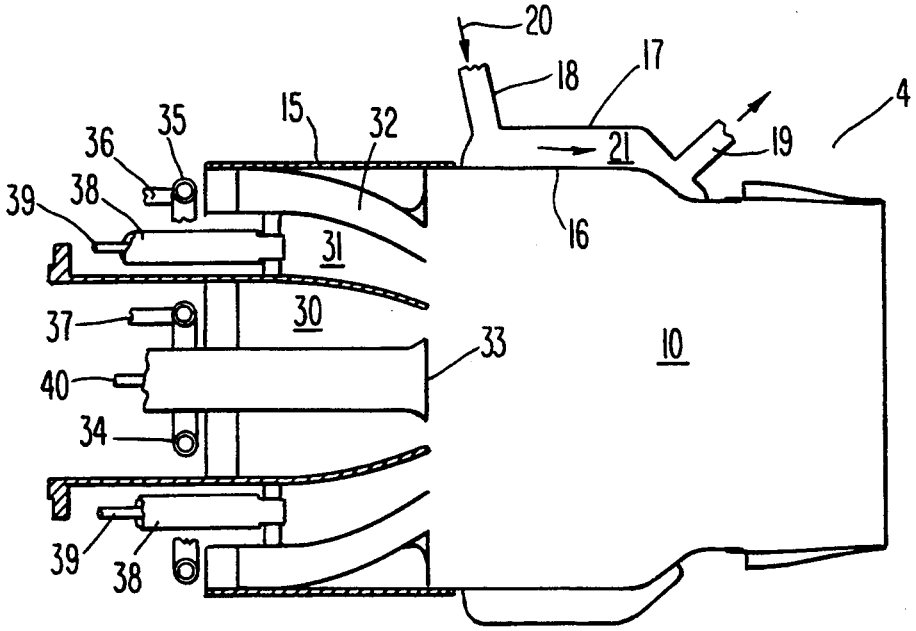
FIG. 2 is a longitudinal cross-section of the combustor shown in FIG. 1 but with a steam cooling jacket added.

Since the walls of the vessel 16 are exposed to the hot gas 9, it is important to cool the vessel. In the embodiment shown in FIG. 1, cooling of the vessel 16 is accomplished by placing the inlet of the pre-mixing zone 14 within the casing 13, thereby causing the compressed air 8 to flow over the outside surfaces of the vessel on its way to the pre-mixing zone. FIG. 2 shows another method of cooling the vessel 16, in which a jacket 17 surrounds the vessel wall. The jacket 17 has an inlet 18 connected to a source of steam 20 and an outlet 19 so that the steam flows through a passage 21 formed between the jacket and the vessel wall, thereby cooling the vessel 16. Alternatively, the jacket inlet could be connected to a source of high pressure air for cooling.

Figure 3:
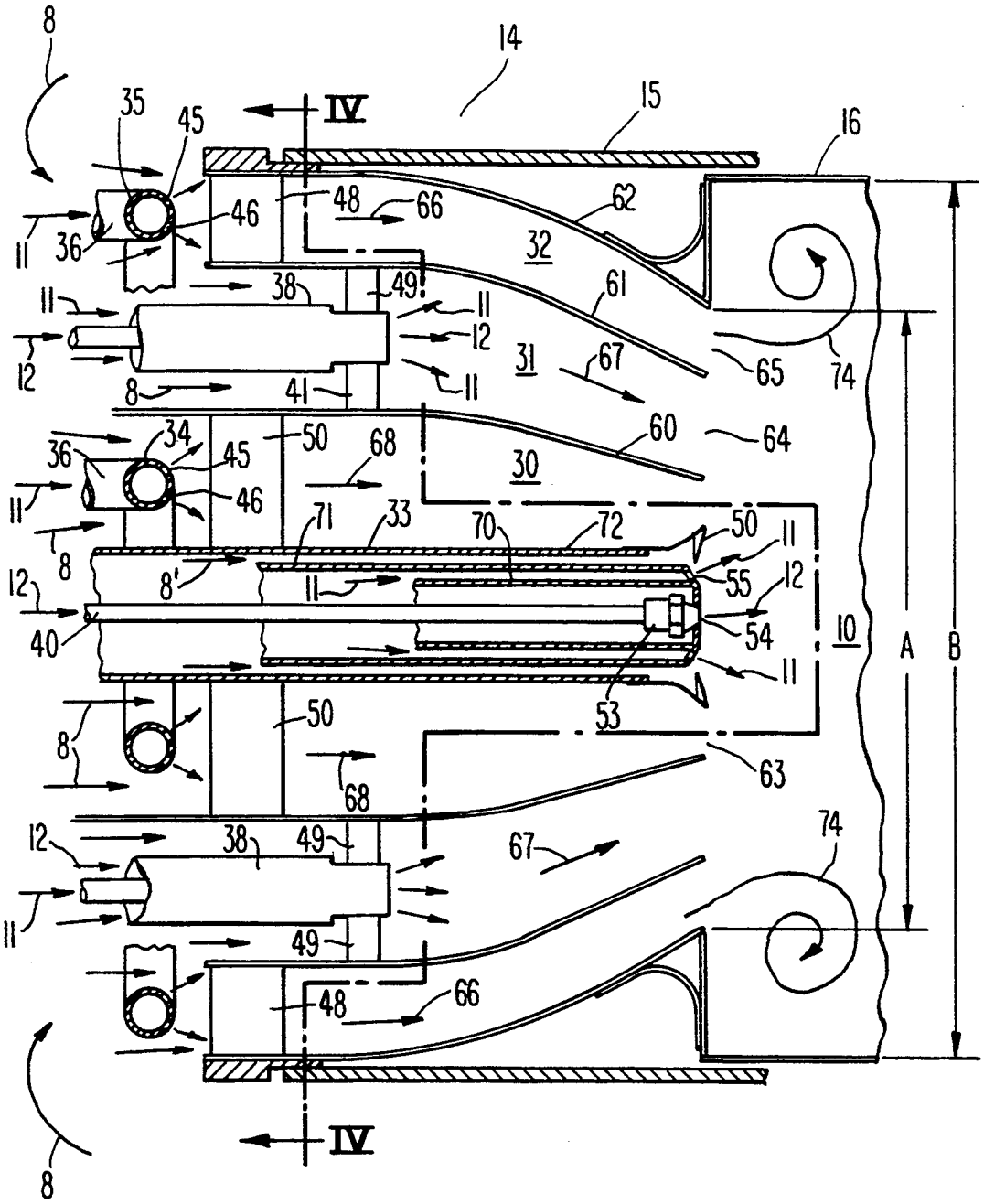
FIG. 3 is a detailed view of the pre-mixing portion of the combustor shown in FIG. 1.
Figure 4:
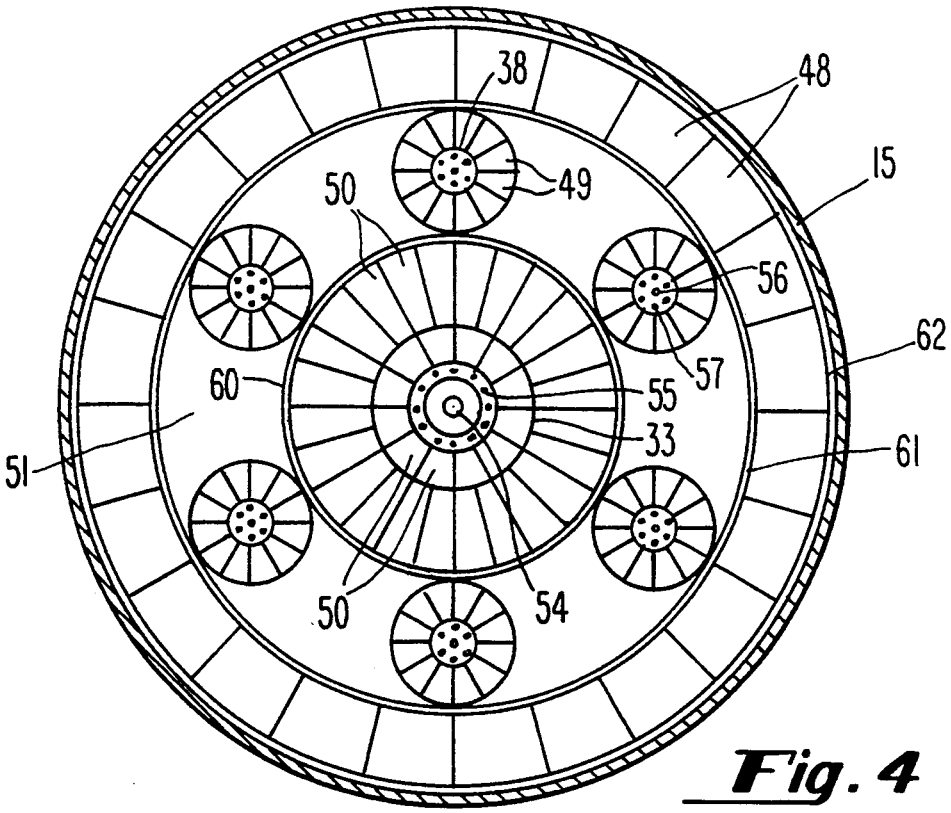
FIG. 4 is a transverse cross-section taken along line IV—IV shown in FIG. 3.

As shown in FIGS. 3 and 4, the pre-mixing zone 14 comprises a casing 15 that encloses three concentrically arranged liners 60–62. Centrally disposed within the inner liner 60 is a dual fuel nozzle 33. An outer annular passage 32 is formed between the outer liner 62 and the middle liner 61, a middle annular passage 31 is formed between the middle liner and the inner liner 60, and an inner annular passage 30 is formed between the inner liner and the fuel nozzle 33.

A plurality of swirl vanes 48 and 50 are circumferentially arrayed about the inner and outer passages 30 and 32, respectively. The swirl vanes may be plate-like or airfoil-shaped and are disposed at an angle to the axis of the gas turbine so as to impart swirl to the mixtures 66 and 68 of gas fuel 11 and air 8 flowing through the passages, thereby inducing good mixing of the fuel and air.

Toroidal gas fuel manifolds 34 and 35 are disposed upstream of the inlets to the inner and outer passages 30 and 32, respectively. Each of the manifolds 34 and 35 are connected to fuel supply pipes 36 that direct gas fuel 11 into the manifold. A plurality of gas fuel discharge ports 45 and 46 are circumferentially spaced around the manifolds 34 and 35. In the preferred embodiment, the discharge ports are spaced circumferentially at about 2.5 cm (1 inch) intervals in the outer manifold 35 and spaced circumferentially at about 1 cm (0.4 inch) intervals in the inner manifold 34. This spacing of the gas fuel discharge ports ensures that the gas fuel 11 is evenly distributed around the circumference of the passages 30 and 32 so as to prevent any locally rich fuel/air mixtures. Rich fuel/air mixtures have a high flame temperature that results in increased NOx production. In addition, at each circumferential fuel discharge port station, two fuel discharge ports are formed in the manifolds 34 and 35, one port 45 oriented to direct fuel at an angle radially outward to the gas turbine axis and the other port 46 oriented to direct fuel at an angle radially inward to the axis. This ensures that the gas fuel 11 is well distributed within the passages 30 and 32 in the radial direction, as well as the circumferential direction.

The central dual fuel nozzle 33, disposed within the inner passage 30, is comprised of an oil fuel supply pipe 40 that directs fuel oil 12 to a spray tip 53, as well as inner, middle and outer sleeves 70–72. The spray tip 53, which is enclosed by the inner sleeve 70, has a oil fuel discharge port 54 formed therein that sprays fine particles of oil fuel 12 into the combustion zone 10. The inner sleeve 70 and the middle sleeve 71 form an annular passage therebetween that directs gas fuel 11 to a plurality of gas fuel discharge ports 55 that introduce the gas fuel into the combustion zone 10. Note that although both gas and oil fuel 11 and 12, respectively, are shown in the drawings for the sake of explanation, it should be understood that in the preferred embodiment, the combustor 4 is operated on only one type of fuel at a time.

The middle sleeve 71 and outer sleeve 72 of the fuel nozzle 33 form an annular passage therebetween that directs compressed air 8' to a plurality of swirl vanes 50 that are attached to the outer sleeve so as to be circumferentially arrayed around the fuel nozzle 33. Swirling the air in this manner aids in mixing the fuel 11,12 exiting the nozzle into the air 8 and creates vortices that anchor the flame, thereby improving stability.

Figure 8:
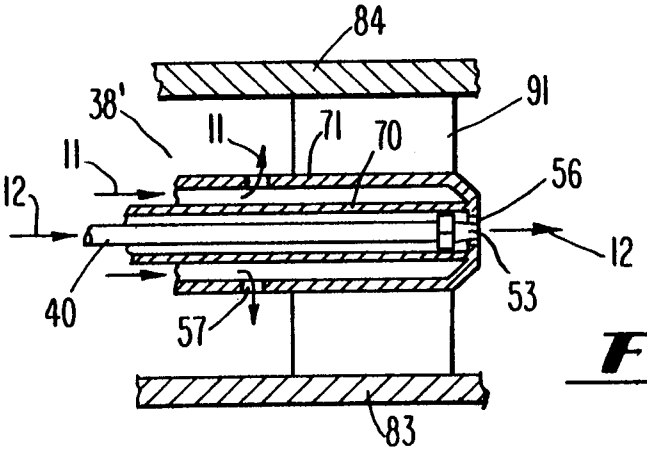
FIG. 8 is a detailed view of the portion of FIG. 6 enclosed by the rectangular marked VIII.

The middle passage 31 of the pre-mixing zone 14 contains a plurality of distributed dual fuel nozzles 38. The fuel nozzles 38, one embodiment of which is shown in FIG. 8, are similar to the central dual fuel nozzle 33, except that the fuel nozzle 38 lacks the outer sleeve 72 and the swirl vanes 50 attached to it. Consequently, the fuel nozzles 38 have an oil fuel discharge port 56 and a plurality of gas fuel discharge ports 57, as shown in FIG. 4. In the preferred embodiment, six fuel nozzles 38 are spaced around the circumference of the middle passage 31 to aid in the distribution of fuel so as to minimize the formation of locally fuel rich areas. However, the fuel introduced into the middle passage 31 by means of the fuel nozzles 38 will not be as well distributed as that introduced into the inner and outer passages 30 and 32, respectively, by the manifolds 34 and 35, thereby resulting in higher NOx production in the middle passage.

Figure 5:
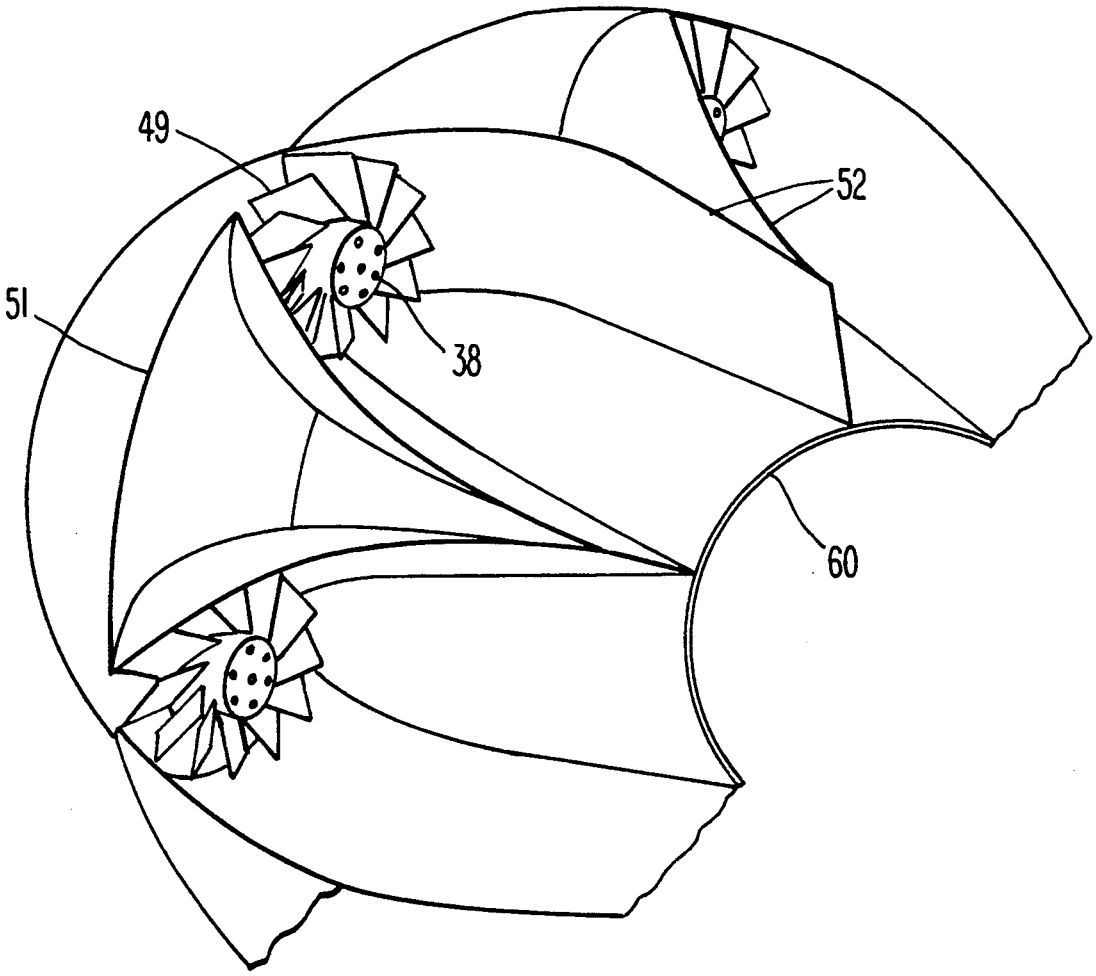
FIG. 5 is an isometric view of a portion of the pre-mixing portion of the combustor shown in FIG. 3 in which flow guides extend downstream from the baffle.

As shown best in FIG. 5, a plurality of swirl vanes 49 are circumferentially arrayed around each of the fuel nozzles 38 so as to pre-swirl the air 8 that flows over the fuel nozzles and mixes with the fuel 11,12 discharged by them. In the embodiment shown in FIGS. 3 and 4, the gas fuel discharge ports 57 of the distributed fuel nozzles 38 are formed in the face of the nozzle, so that the swirl vanes 49 are disposed upstream of the ports and swirl only the air 8. However, as shown in the embodiment in FIG. 8, the gas fuel discharge ports 57 may also be formed in the circumference of the sleeve 71 so that swirl vanes 91 are disposed upstream of the gas fuel discharge ports so as to swirl the gas fuel/air mixture.

As shown in FIGS. 4 and 5, a circular baffle 51 is disposed in the middle passage 31 and extends between the inner liner 60 and the middle liner 61. Segments of the baffle 51 are disposed between each of the fuel nozzles 38, thereby blocking the portions of the middle passage 31 between the fuel nozzles so as to direct the flow of compressed air 8 around each of the fuel nozzles. In order to allow the fuel/air mixture 67 to flow smoothly through the middle passage 31 downstream of the baffle 51, flow guides 52 may be located in the passage, as shown in FIG. 5. The flow guides 52 extend forwardly from the ends of each segment of the baffle 51 and meet at the passage outlet 64, mid-way between each distributed fuel nozzle 38.

Referring again to FIG. 1, the operation of the combustor 4 is as follows. During start-up, the compressor 2 is spun-up to ignition speed, typically approximately 18% to 20% of design speed, by a starting motor (not shown). As the compressor rotor accelerates, compressed air 8 from the compressor 2 flows into the combustor 4 from the cavity formed by the casing 13. As shown in FIG. 3, after entering the combustor 4, the air is divided into three main streams in the pre-mixing zone—one stream flowing through each of the three annular passages 30–32.

As those skilled in the art will readily appreciate, not all of the air 8 produced by the compressor 2 is used as combustion air. Instead some of the compressed air is bled from the compressor 2 and used for cooling purposes in the turbine 3. However, according to the current invention, all of the combustion air enters the combustor 4 through the pre-mixing zone 14, primarily via the passages 30–32. A small portion of the compressor air 8'—i.e., less than approximately 2% of the combustion air—is drawn from the chamber 7 and then reintroduced into the combustion section by flowing it through the annular passage formed between the middle and outer sleeves 71 and 72, respectively, of the central dual fuel nozzle 33, as previously discussed. While this small portion of compressed air 8' flows through the premixing zone 10, it is not pre-mixed with fuel but is discharges directly into the combustion zone 10.

When ignition speed is reached, gas 11 or oil 12 fuel, as selected by the operator, is introduced into the combustion zone 10 via the central fuel nozzle 33 to provide a locally rich mixture of fuel and air downstream of the fuel nozzle in order to facilitate ignition. Combustion is established by supplying power, before the introduction of the fuel, to an igniter 110, shown in FIG. 1.

As a result of the locally rich fuel/air ratio of the mixture created by the central nozzle 33 and the flame anchoring effect of the swirl vanes 50, a very stable pilot flame is obtained in a central portion of the combustion zone 10 just downstream of the nozzle. Such combustion, in which the fuel and air are mixed in a fuel rich ratio immediately upstream of the flame front is generally referred to as "diffusion" type combustion.

Unfortunately, the diffusion type combustion associated with the central dual fuel nozzle 33 results in locally high gas temperatures, and therefore, high rates of NOx formation. Thus, according to the current invention, as the speed of the gas turbine increases beyond ignition speed, the combustion of further fuel, especially when operating on gas fuel, occurs primarily in ultra-lean pre-mix type combustion, rather than further fuel rich diffusion type combustion. As is well known in the art, lean combustion minimizes local gas temperatures within the combustion zone and, therefore, the formation of NOx. As used herein, a lean fuel/air mixture is one in which the ratio of fuel to air is less that about 0.02 by weight.

According to the current invention, when operating on gas fuel 11, such ultra-lean pre-mixed combustion is obtained by introducing the fuel at lean fuel/air mixtures into the inner and outer annular passage 30 and 32, which surround the central fuel nozzle 33, via the fuel manifolds 34 and 35. As the gas fuel 11 flows through the annular passages 30 and 32, the length of the passages and the presence of the turbulence inducing swirl vanes 48 and 50 promotes a high degree of mixing between the fuel and air. Such mixing, along with the wide distribution of the fuel by the ports 45 and 46 in the manifolds, ensures that the resulting streams of fuel and air 66 and 68 have lean fuel/air ratios throughout. As a result, there are no locally fuel rich zones that would promote the generation of NOx.

In the middle passage 31, gas fuel is introduced via the six distributed dual fuel nozzles 38. Although introducing fuel in this manner allows for leaner fuel/air ratios—and, therefore, lower flame temperatures and NOx production—than can be achieved by the single source fuel nozzles traditionally used, it is expected that the NOx will be higher than that associated with the ultra-lean pre-mixing achieved in the passages 30 and 32. However, use of the distributed dual fuel nozzles 38 has the advantage of allowing operation on oil fuel, as well as gas fuel. Moreover, it should be noted that the distributed fuel nozzles 38, as well as the central fuel nozzle 33, can be readily replaced for maintenance by removing a cover plate 111, shown in FIG. 1, and withdrawing the nozzles from the pre-mixing zone 14.

After flowing through the annular passages 30–32, the fuel/air mixtures 66–68 exit the pre-mixing zone 14, via the passage outlets 63–65, and enter the combustion zone 10, as shown in FIG. 3. In the combustion zone 10, the lean fuel/air mixtures from passages 30–32 are ignited by the flame from the central fuel nozzle 33, thereby creating additional, concentric flame fronts within the combustion zone 10 that surround the flame from the central fuel nozzle.

In the preferred embodiment, gas fuel 11 is supplied to the annular passages 30–32 sequentially. Thus, as increased loading on the turbine 3 demands higher temperatures of the hot gas 9, additional gas fuel 11, beyond that introduced by the central fuel nozzle 33 to obtain ignition, is initially supplied to only the inner annular passage 30, via the fuel manifold 34 immediately upstream of that annular passage. After the fuel/air mixture flowing through annular passage 30 has been ignited, creating an annular flame in a portion of the combustion zone surrounding the flame from the central nozzle 33, further increases in firing temperature are accomplished by increasing the gas fuel supplied to the inner annular passage 30 by its fuel manifold 34 but only until the fuel/air ratio within that annular passage reaches a predetermined amount—in the preferred embodiment, about 0.035 by weight.

Thereafter, further increases in load are accomplished by supplying gas fuel to outer annular passage 32, via its fuel manifold 35, thereby creating a second annular flame surrounding the first annular flame. After combustion is established with respect to the second annular flame, the amount of fuel in the inner annular passage 30 can be reduced so that the fuel/air ratio in the inner passage drops below the pre-determined amount, preferrably below 0.02, so as to maintain leaner combustion. Additional gas fuel is supplied to the outer annular passage 32 until its fuel/air ratio reaches the predetermined amount.

Still further increases in load are then accomplished by supplying gas fuel to the middle annular passage 31, via the distributed fuel nozzles 38, thereby creating a third annular flame surrounding the first annular flame. Again, after combustion is established with respect to the third annular flame, the amount of fuel in the outer annular passage 32 can be reduced so that the fuel/air ratio in the outer passage drops below the pre-determined amount, preferrably below 0.02, so as to maintain leaner combustion. The result of this operating sequence is a flame that extends radially within the combustion zone 10 as the firing temperature of the combustor 6 increases without ever creating a rich fuel/air ratio stream. In this manner, very lean fuel/air mixtures 66–68, and therefore, low NOx production, can be maintained over the entire operating range.

When operating on oil fuel 12, increases in firing temperature beyond a certain amount are achieved by introducing additional oil fuel 12 through the six distributed dual fuel nozzles 38 in the middle annular passage 31, rather than through the central fuel nozzle 33. As previously discussed, although it may not be possible to achieve as lean fuel/air ratios within the middle passage 31 as in the inner and outer passages in gas fuel operation, the NOx production will be less than that resulting from operation on the central fuel nozzle 33 alone. When operating on oil fuel, no fuel is introduced into the inner and outer passages 30 and 32.

As a further refinement, according to the current invention, regardless of the type of fuel, after combustion is established with respect to the lean fuel/air mixtures flowing through the annular passages 30–32, the fuel supplied to the central fuel nozzle 33, with its associated diffusion type combustion high NOx production, may be eliminated so that only lean pre-mix combustion is utilized.

Typically, the flame stability of combustion at the lean fuel/air ratios with which the combustor 4 of the current invention operates, except for that of the diffusion flame associated with the central fuel nozzle 33, is poor, thereby creating the possibility of blow-out. However, according to the current invention, good flame stability is achieved by the use of the central diffusion flame in the center of the combustion zone and by the sudden expansion of the fuel/air mixtures as they enter the combustion zone 10 from the pre-mixing zone 14. The sudden expansion creates vortices 74 of recirculating flow that tend to anchor the flame and prevent blow-out.

The sudden expansion is created by a step change in the diameter of the flow area in going from the pre-mixing zone 14 to the combustion zone 10. As shown in FIG. 3, the flow area—that is, the cross-sectional area in a plane perpendicular to the axis of the combustor 4—of the pre-mixing zone 14 is defined by the inner diameter A of the outer liner 62 at the outlet 65 of the outer passage 32. The flow area of the combustion zone 10 is defined by the inner diameter B of the shell 16. In the preferred embodiment, the diameter B of the shell is at least 40% greater than the diameter A of the outer liner 62, thereby ensuring a sufficiently large abrupt increase in diameter to achieve the desired flame stabilizing effect.

Figure 7:
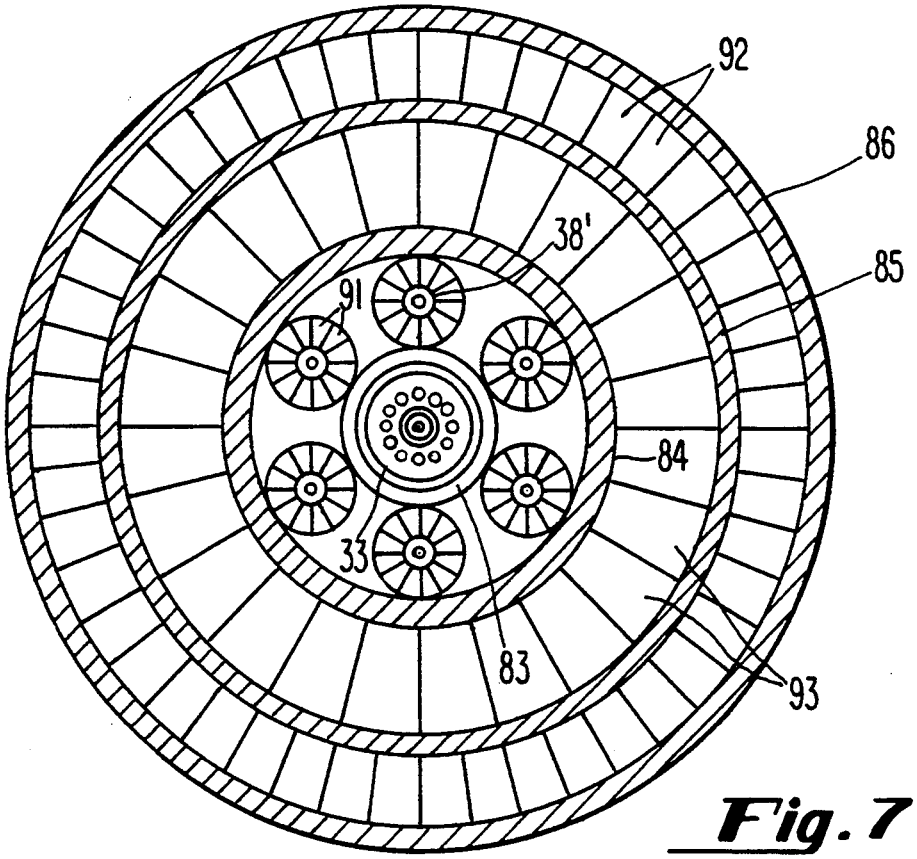
FIG. 7 is a transverse cross-section taken along line VII—VII shown in FIG. 6.
Figure 6:
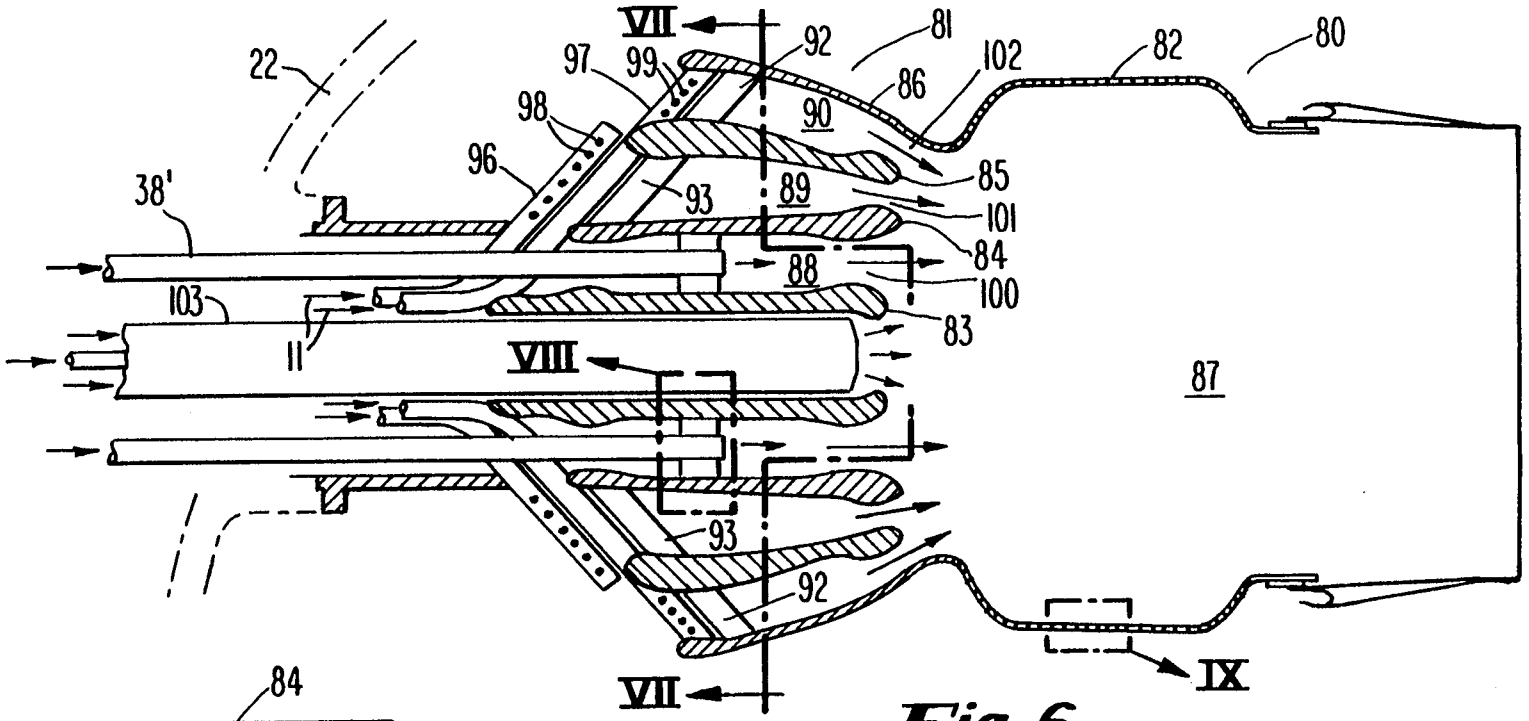
FIG. 6 is an alternate embodiment of the combustor according to the current invention.

FIGS. 6 and 7 show another embodiment of the combustor 80 according to the current invention. In this embodiment, the pre-mixing zone 81 is comprised of three annular passages 88–90 formed by four liners 83–86. A dual fuel nozzle 103 is centrally disposed as before. However, the nozzle 103 does not have an outer sleeve 72 nor the swirl vanes 50. Instead, it is enclosed by the liner 83. Gas fuel is supplied to the middle and outer passages 88 and 90 by means of a plurality radially extending spray bars 96 and 97, respectively, dispersed about the circumference of the passages. In the preferred embodiment, six spray bars 96 and 97 are utilized in each annular passage to distribute the gas fuel 11 circumferentially. In addition, a number of gas fuel discharge ports 98 and 99 are formed along each spray bar to radially distribute the fuel. Moreover, the distributed dual fuel nozzles 38' shown in FIG. 8, are located in the inner passage 88, rather than in the middle passage as in the embodiment shown in FIGS. 1–5.

Figure 9:
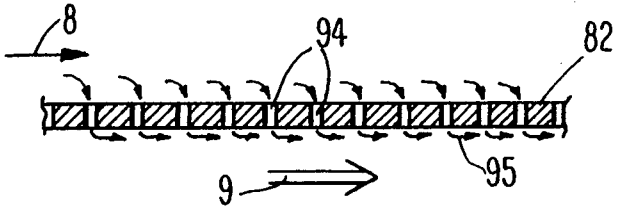
FIG. 9 is a detailed view of the portion of FIG. 6 enclosed by the rectangular marked IX.

In this embodiment, the liners 83–86 are shaped so as to form throats at the passage outlets 100–102. These throats creates a venturi effect that promotes flame stability, along with the abrupt increase in diameter previously discussed, and prevents flash backs. In addition, the shell 82 that encloses the combustion zone 87 has transpiration cooled walls. As shown in FIG. 9, a small amount of cooling air is bled through numerous small holes 94 in the shell 82 to create a film 95 of cooling air along the inner surface of the shell.

This embodiment is especially suited for retro-fitting into existing gas turbines since the pre-mixing zone 81 does not extend beyond the gas turbine casing 22, shown in phantom in FIG. 6.

The present invention may be embodied in other specific forms without departing from the spirit or essential attributes thereof and, accordingly, reference should be made to the appended claims, rather than to the foregoing specification, as indicating the scope of the invention.

We claim:

1. A gas turbine, comprising:

a) a compressor for compressing air;

b) a combustor for producing a hot gas by burning a fuel in said compressed air, said combustor having:

(i) a combustion zone, (ii) a centrally disposed first fuel nozzle in flow communication with said combustion zone and having a first discharge port for discharging a liquid fuel and a second discharge port for discharging a gaseous fuel, (iii) first and second concentrically arranged annular passages surrounding said first fuel nozzle and in flow communication with said combustion zone, (iv) means for introducing a liquid fuel into said first passage so as to circumferentially distribute said liquid fuel around said first passage, (v) first means for introducing a gaseous fuel into said second passage so as to circumferentially distribute said gaseous fuel around said second passage; and c) a turbine for expanding said hot gas produced by said combustor.

2. The gas turbine according to claim 1, further comprising second means for introducing a gaseous fuel into said first passage so as to circumferentially distribute said gaseous fuel around said first passage.

3. The gas turbine according to claim 2, further comprising a plurality of second fuel nozzles circumferentially distributed around said first passage, and wherein:

a) said second gas fuel introducing means comprises a first gas fuel discharge port formed in each of said second fuel nozzles; and b) said liquid fuel introducing means comprises a second liquid fuel discharge port formed in each of said nozzles.

4. The gas turbine according to claim 3, further comprising a plurality of first swirl vanes distributed circumferentially around each of said second fuel nozzles.

5. The gas turbine according to claim 4, wherein:

a) said first passage has an inlet in flow communication with said compressor, whereby said inlet receives a first portion of said compressed air from said compressor; and b) said first swirl vanes are disposed downstream of said first passage inlet and between said first gas fuel discharge ports and said combustion zone, whereby said first swirl vanes create pre-mixing of said first portion of said compressed air and a gaseous fuel from said first gas fuel ports prior to said compressed air and said gas fuel entering said combustion zone.

6. The gas turbine according to claim 4, further comprising a plurality of second swirl vanes distributed circumferentially around said second passage, and wherein:

a) said first gas fuel introducing means comprises a plurality of second gas fuel discharge ports circumferentially arrayed within said second passage;

b) said second passage has an inlet in flow communication with said compressor, whereby said inlet receives a second portion of said compressed air from said compressor; and c) said second swirl vanes are disposed between said second gas fuel discharge ports and said combustion zone, whereby said second swirl vanes create pre-mixing of said second portion of said compressed air and a gaseous fuel from said second gaseous fuel discharge ports prior to said second portion of said compressed air and said gas fuel entering said combustion zone.

7. The gas turbine according to claim 6, further comprising:

a) a third annular passage concentrically arranged with respect to said first and second passages, said third passage surrounding said first fuel nozzle and in flow communication with said combustion zone;

b) third means for introducing a gaseous fuel into said third passage so as to circumferentially distribute said gaseous fuel around said third passage;

c) a plurality of third swirl vanes distributed circumferentially around said third passage, and wherein:

(i) said third gas fuel introducing means comprises a plurality of third gas fuel discharge ports circumferentially arrayed within said third passage;

(ii) said third passage has an inlet in flow communication with said compressor, whereby said inlet receives a third portion of said compressed air from said compressor; and (iii) said third swirl vanes are disposed between said third gas fuel discharge ports and said combustion zone, whereby said third swirl vanes create premixing of said third portion of said compressed air and a gaseous fuel from said third gaseous fuel discharge ports prior to said third portion of said compressed air and said gas fuel entering said combustion zone.

8. The gas turbine according to claim 1, wherein said liquid fuel introducing means comprises a plurality of fuel nozzles circumferentially arrayed within said first annular passage, each of said fuel nozzles having a liquid fuel discharge port formed therein.

9. The gas turbine according to claim 1, wherein said first gas fuel introducing means comprises a plurality of gas fuel discharge ports circumferentially arrayed within said second passage.

10. The gas turbine according to claim 9, further comprising a plurality of swirl vanes distributed circumferentially around said second passage, and wherein:

a) said second passage has an inlet in flow communication with said compressor, whereby said inlet receives said compressed air; and b) said swirl vanes are disposed between said gas fuel discharge ports and said combustion zone, whereby said swirl vanes create pre-mixing of said compressed air and a gas fuel from said gaseous fuel discharge ports prior to said compressed air and said gas fuel entering said combustion zone.

11. The gas turbine according to claim 9, wherein said first gas fuel introducing means further comprises a toroidal gas fuel manifold extending around said second passage, said gas fuel discharge ports being distributed around said toroidal manifold.

12. The gas turbine according to claim 1, wherein said second passage surrounds said first passage.

13. The gas turbine according to claim 1, wherein said first passage surrounds said second passage.

14. The gas turbine according to claim 1, further comprising a third annular passage concentrically arranged with said first and second passages, said third passage surrounding said first fuel nozzle and in flow communication with said combustion zone.

15. The gas turbine according to claim 14, further comprising means for introducing a gaseous fuel into said third passage so as to circumferentially distribute said gaseous fuel around said third passage.

16. The gas turbine according to claim 15, wherein said third passage surrounds said first and second passages.

17. The gas turbine according to claim 15, wherein said first passage is disposed between said second and third passages.

18. In a gas turbine having a compressor for producing compressed air, a combustor comprising:

a) a shell forming a combustion zone in which a fuel is burned in compressed air;

b) a fuel/air pre-mixing zone enclosed by a first liner, said first liner enclosing second and third liners, a first annular passage formed between said first and second liners and a second annular passage formed between said second and third liners, each of said annular passages having an inlet in flow communication with said compressor and an outlet in flow communication with said shell, whereby a portion of said compressed air from said compressor flows through each of said annular passages, said premixing zone having a flow area defined by an inner diameter of said first liner at said first passage outlet, said shell having a flow area adjacent said passage outlets defined by an inner diameter of said shell, said shell inner diameter being at least about 40% greater that said first liner inner diameter, whereby said compressed air flowing through said passages undergoes an expansion upon exiting said passages;

c) means for introducing a fuel into each of said passages; and d) means, disposed within said passages, for mixing said fuel introduced into each of said annular passages with said compressed air flowing through said passages.

19. The combustor according to claim 18, wherein said means for mixing said fuel comprises a plurality of swirl vanes disposed in each of said passages.

20. The combustor according to claim 18, further comprising means for introducing a fuel centrally within said shell.

* * * * *

US005359847B1

REEXAMINATION CERTIFICATE (2841st)

United States Patent [19] [11] B1 5,359,847

Pillsbury et al. [45] Certificate Issued Apr. 9, 1996

[54] DUAL FUEL ULTRA-LOW NOX COMBUSTOR

[75] Inventors: Paul W. Pillsbury, Winter Springs; David T. Foss, Winter Park, both of Fla.

[73] Assignee: Westinghouse Electric Corporation, Pittsburgh, Pa.

Reexamination Request:
No. 90/003,823, May 8, 1995

Reexamination Certificate for:

| | |
|---|---|
| Patent No.: | **5,359,847** |
| Issued: | **Nov. 1, 1994** |
| Appl. No.: | **69,496** |
| Filed: | **Jun. 1, 1993** |

[21] Appl. No.: 69,496

[51] Int. Cl.[6] ..... F02C 7/26

[52] U.S. Cl. ..... 60/39.06; 60/39.463; 60/737; 60/742; 60/748

[58] Field of Search ..... 60/39.06, 39.37, 60/39.463, 737, 739, 740, 742, 748; 239/416.1, 416.4, 404, 405, 406

[56] References Cited

U.S. PATENT DOCUMENTS

| | | | |
|---|---|---|---|
| 3,691,765 | 9/1972 | Carlisle | 60/742 |
| 3,788,067 | 1/1974 | Carlisle et al. | 60/748 |
| 3,937,011 | 2/1976 | Caruel et al. | 60/742 |
| 3,958,416 | 5/1976 | Hammond, Jr. et al. | 60/737 |
| 4,216,517 | 4/1981 | Hopkins et al. | 239/406 |
| 4,447,010 | 5/1984 | Maeda et al. | 239/416.1 |
| 5,044,559 | 9/1991 | Russell et al. | 239/406 |
| 5,069,029 | 12/1991 | Kuroda et al. | 60/737 |
| 5,121,597 | 6/1992 | Urushidani et al. | 60/747 |
| 5,127,221 | 7/1992 | Beebe | 60/39.02 |
| 5,218,824 | 6/1993 | Cederwall et al. | 60/742 |
| 5,235,814 | 8/1993 | Leonard | 60/738 |
| 5,237,812 | 8/1993 | Mumford | 60/39.463 |

FOREIGN PATENT DOCUMENTS

| | | | |
|---|---|---|---|
| 0455487 | 6/1991 | European Pat. Off. . | |
| 00119423 | 9/1981 | Japan | 60/39.37 |
| 59-173633 | 10/1984 | Japan . | |
| 0063721 | 3/1989 | Japan | 60/737 |
| 0093210 | 4/1990 | Japan | 60/737 |
| 0183720 | 7/1990 | Japan | 60/737 |
| 1099959 | 1/1968 | United Kingdom . | |

OTHER PUBLICATIONS

Owen et al., "Low Emmssions Combustor Design Options for an Aero Derived Industrial Gas Turbine Engine", Canadian Gas Association Symposium, Banff, Alberta, (Oct. 16–18, 1991).

*Primary Examiner*—Timothy S. Thorpe

[57] ABSTRACT

An ultra-low NOx gas turbine combustor having a dual fuel capability. The combustor has a pre-mixing zone and a downstream combustion zone. The pre-mixing zone has three concentric annular passages that surround a central diffusion-type dual fuel nozzle. A gas fuel manifold distributes gas fuel around the inner and outer passages. A plurality of dual fuel nozzles are disposed in the middle passage to distribute either gas or oil fuel around the middle passage. The distribution of fuel around the passages allows the formation of lean fuel/air ratios, thereby lowering NOx formation. In addition, swirl vanes are arrayed around the inner and outer passages and around each of the fuel nozzles. A step increase in the flow area in going from the pre-mixing zone to the combustion zone creates vortices that tend to anchor the flame.

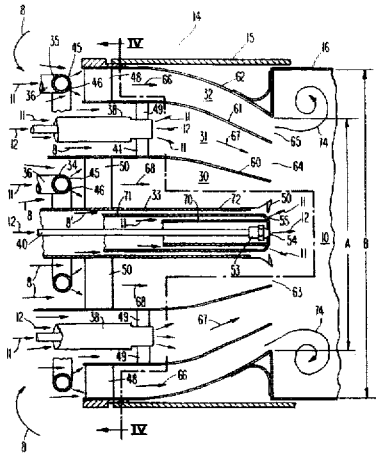

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS

BEEN DETERMINED THAT:

The patentability of claims 1–20 is confirmed.

* * * * *